US007169021B2

(12) United States Patent
Tuovinen

(10) Patent No.: US 7,169,021 B2
(45) Date of Patent: Jan. 30, 2007

(54) ARRANGEMENT FOR TREATING PULPSTONE SURFACE

(75) Inventor: Olli Tuovinen, Tampere (FI)

(73) Assignee: Metso Paper Inc., Helsinki (FI)

( * ) Notice: Subject to any disclaimer, the term of this patent is extended or adjusted under 35 U.S.C. 154(b) by 56 days.

(21) Appl. No.: 10/510,270

(22) PCT Filed: Apr. 17, 2003

(86) PCT No.: PCT/FI03/00313

§ 371 (c)(1),
(2), (4) Date: Oct. 5, 2004

(87) PCT Pub. No.: WO03/089715

PCT Pub. Date: Oct. 30, 2003

(65) Prior Publication Data

US 2005/0116072 A1 Jun. 2, 2005

(30) Foreign Application Priority Data

Apr. 19, 2002 (FI) ..... 20020764

(51) Int. Cl.
*B02C 25/00* (2006.01)

(52) U.S. Cl. ..... 451/28; 451/41; 451/5

(58) Field of Classification Search ..... 451/5, 451/6–10, 36, 41, 28; 83/177
See application file for complete search history.

(56) References Cited

U.S. PATENT DOCUMENTS 5,178,496 A * 1/1993 Trieb et al. ..... 406/14
5,184,434 A * 2/1993 Hollinger et al. ..... 451/36
5,727,992 A 3/1998 Blomqvist et al.
6,634,928 B2 * 10/2003 Erickson et al. ..... 451/40
2005/0116072 A1 * 6/2005 Tuovinen ..... 241/28

FOREIGN PATENT DOCUMENTS

CA 495133 9/1947
WO WO 00/73571 A1 12/2000

OTHER PUBLICATIONS

Kalliokoski, et al., "Kokemuksia Tietokonepohjaisesta Hiomon Ohjauksesta", 1982, pp. II/123-II/136, Kuva 7, Kajaani OY:N PGW:N Freenesshajontoja.
Kärnä et al., "Control of pressurized grinding: Initial experiences at Anjala", *Pulp & Paper Canada*, 1985, pp. T377-T383, vol. 86, No. 12.
Talvio et al., "AGMO - automatic groundwood mill operator", *Pulp & Paper Canada*, 1974, 44. T268-T269, vol. 75, No. 7.

* cited by examiner

*Primary Examiner*—Lee D. Wilson
(74) *Attorney, Agent, or Firm*—Alston & Bird LLP

(57) ABSTRACT

A method for controlling the water jet sharpening sequence of a pulp grinder is provided, wherein a high-pressure sharpening water jet is directed toward a surface of a pulpstone with a water sharpening apparatus. An actual quality value of the fiber pulp is determined for at least one variable, and a target quality value is defined for each of the at least one variable. The actual quality values and corresponding target quality values are transmitted to a control unit that includes an adjustment strategy set for controlling water sharpening of the pulpstone. According to the adjustment strategy, the treatment pressure and/or the treatment interval of the sharpening water jet is controlled relative to an error value between the target quality value and the actual quality value of the fiber pulp. An associated apparatus is also provided.

16 Claims, 4 Drawing Sheets

ARRANGEMENT FOR TREATING PULPSTONE SURFACE

BACKGROUND OF THE INVENTION

1. Field of the Invention

The invention relates to a method and apparatus for treating the surface of the pulpstone of a pulp grinder.

2. Description of Related Art

In general, mechanical pulp is made in piston-loaded pulp grinders, in which the wood material, such as blocks of wood, chips or the like, in pockets thereof are pressed by a loading cylinder and pressure shoe against a pulpstone that rotates longitudinally. In pulp grinders of this kind, the grinding space can be either pressurized or non-pressurized. Another commonly used grinder type is a chain pulp grinder that is characterized by a wood pocket arranged directly above the pulpstone and having two endless chains for feeding the wood against the pulpstone. The chain grinder is a continuous grinder, i.e. wood can be added to the grinder continuously without disturbing the grinding process. To provide the cooling and lubrication required in the grinders and to transport pulp out of them, the pulpstone is sprayed with water. As a result of the grinding effect of the pulpstone and the softening effect of water, the wood fibers detach from the wood material and form, together with water, a fiber pulp suspension.

It is generally known that making mechanical pulp is unstable due to many randomly varying factors. These factors include variations in the quality, size and moisture-content of wood, cleanness of the stone surface, quality of the stone, its surface or cutting pattern, the wear of the grinding surface, and the force pressing the wood against the stone. Non-stability becomes evident in the variation of pulp consistency, quality and fineness. A CSF value is conventionally used as the measure of fineness and correlates quite well with the many quality properties of pulp. The higher the CSF value of pulp, the rougher the pulp.

Even though the pulpstone is significantly harder than the wood fibers, the surface of the pulpstone does wear to some extent during grinding. The surface pattern and roughness of the pulpstone then change and, consequently, the abrasiveness and grinding properties of the stone change correspondingly. As a result, the properties of the formed fibers, and thus also the properties of the fiber pulp suspension, change on the long run, and the usability of the fiber pulp in paper-making, for instance, varies as do the properties of the produced paper. So as to avoid these drawbacks, the pulpstone is reconditioned by "sharpening" it, i.e. by removing material from the surface of the pulpstone to make its properties as desired.

In the prior art, sharpening of the pulpstone is done by moving a bush roll along the surface of the pulpstone and pressing it to the surface of the pulpstone while rotating the pulpstone. As a result of this, material detaches from the surface of the pulpstone over part of the surface, i.e. over the contact area of the bush roll and pulpstone, and this way, by moving the bush roll in the axial direction of the pulpstone, material can be removed from the area of its entire surface, while the pulpstone rotates. With a suitably shaped bush roll, a pulpstone that has become blunt can be reconditioned. This type of solution is known from FI patent 26854, for instance.

A drawback with these known solutions is that during the sharpening stage, the rolls, when turning, not only remove stone material but also break the grinding grains and the edges of the cracked grinding grains become extremely sharp and act almost like a knife. As a result of this, fiber pulp obtained with the pulpstone after its sharpening is sliver-like and contains a great deal of cut short fibers, which reduces the usability of the pulp formed immediately after sharpening. This is why the use of a bush roll is avoided and sharpening is done at relatively long intervals. This, in turn, results in that the CSF value that typically describes the variation of pulp properties varies greatly between two sharpening operations.

In existing commercial systems, the quality and production control of pulp grinders is based on what is known as target range control. According to target range control, quite a large operating range is allowed for an individual pulp grinder both in ground pulp quality and in pulpstone sharpness. The reason for this procedure is in the pulpstone surface treatment technique using steel rolls. Roll sharpening causes quite a big change in quality after the treatment that needs to be compensated for by altering the production speed or grinding power. Many earlier control systems are based on models, in which the change of the pulpstone surface on the long run is predicted using a computational sharpness of the pulpstone. The quality of pulp with a specific pulpstone sharpness is, in turn, predicted with a CSF model, in which the descriptor is not only the sharpness of the pulpstone, but also the grinding power or production speed. "Tavio, P., Korhonen, J.: *AGMO—Automated Groundwood Mill Operator, Pulp Paper Mag. Can.* 75 (1974), pages T 268 to T 272"; *Kallioniemi, J.: Kokemuksia tietokonepohjaisesta hiomon ohjauksesta* (*Experience in computer-based groundwood mill control*), *Automaatiopäivät* 1984, publication 10, volume II, publisher Suomen Säätötekninen Seura, pages 123 to 136"; and "Kärnä, A., Liimatainen, H.: *Control of pressurized grinding: Initial experiences at Anjala, Pulp Paper Can.* 86 (1985) 12, pages T 377 to T383" describe the above-mentioned control systems.

U.S. Pat. No. 5,727,992 describes a method for sharpening a pulpstone with a high-pressure water jet. The sharpening is done with equipment comprising at least one nozzle that is connected to move in the axial direction of the pulpstone during sharpening in such a manner that the entire width of the pulpstone is treated by the sharpening water jet sprayed from the nozzle. A pressure pump is connected to the nozzle to pump a high-pressure water jet through the nozzle against the surface of the pulpstone while the pulpstone is rotated during sharpening.

This water sharpening technique allows for a more controlled treatment of the pulpstone surface than the roll sharpening, and the compensation of the quality change in pulp by altering the production speed or grinding power of the pulp grinder is almost unnecessary. In addition, the technique makes it possible to have the same quality target for all pulp grinders and the target range principle can be dropped. Further, the publication states that the CSF value of pulp is monitored essentially continuously and water sharpening is started when the CSF value reaches a predefined low limit, and water sharpening is stopped when the CSF value reaches a predefined high limit.

WO publication 00/73571 describes a similar method for sharpening a pulpstone as in the U.S. Pat. No. 5,727,992, in which an optimization algorithm is added to the method. This publication also emphasizes that in water sharpening, the treatment pressure of the pulpstone can be raised during the treatment.

A drawback with the arrangements described above is, however, that they assume that the quality of pulp is monitored during water sharpening and water sharpening is stopped when the quality of pulp differs from the target to a certain extent. A further problem with the arrangements is that the quality of pulp cannot be measured very quickly in practice, especially if tearing strength is used as a control criterion. Thus, the speed of determining the quality of pulp affects the degree of sharpness provided for the pulpstone during this time.

SUMMARY OF THE INVENTION

The above and other needs are met by the present invention, which provides a treatment pressure and/or treatment interval of the pulpstone surface of a piston-loaded pulp grinder that is controlled with a fuzzy logic device having, as input, the error value of the CSF setting provided by the operator and the computational or measured CSF value or the computational CSF value corrected with the measured CSF value. Correspondingly, the input of a fuzzy logic device in a chain grinder is the error value of the current value of the CSF setting provided by the operator and the computational or measured CSF value or the computational CSF value corrected with the measured CSF value.

The water sharpening pressure is adjusted by the CSF value of the produced pulp or the CSF value calculated from the process variables and the variables describing the use of the pulp grinder resources, and the interval between the water sharpening operations is controlled to keep the water sharpening pressure within the control range.

In another embodiment, the water sharpening interval is adjusted by the CSF value of the produced pulp, or the CSF value calculated from the process variables and the variables describing the use of the pulp grinder resources, and the water sharpening pressure is controlled to keep the water sharpening interval within the control range.

The arrangement of the invention uses a principle in which the pulp quality and production resources of each pulp grinder in one pulp grinding production line are controlled separately. According to the arrangement, each pulp grinder in one production line achieves the same target pulp quality by maximizing the use of the production resources of the pulp grinders.

One advantage of the invention is that removing one single pulp grinder from the pulp grinding product line, or adding one to it, does not change the total quality of pulp or the consistency of combined pulp.

Another advantage of the invention is that the energy consumption of combined pulp is minimized when the quality differences between the pulp grinders in one pulp grinding production line are at their minimum.

An additional advantage of the invention is that the production capacity of a single pulp grinder is optimized independent of the other pulp grinders.

Yet another advantage of the invention is that the control of the grinding process becomes simpler and the variation in the consistency in the grinder pit is minimized when the production speed is not primarily used to control the pulp quality of the pulp grinder.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

Figure 1:
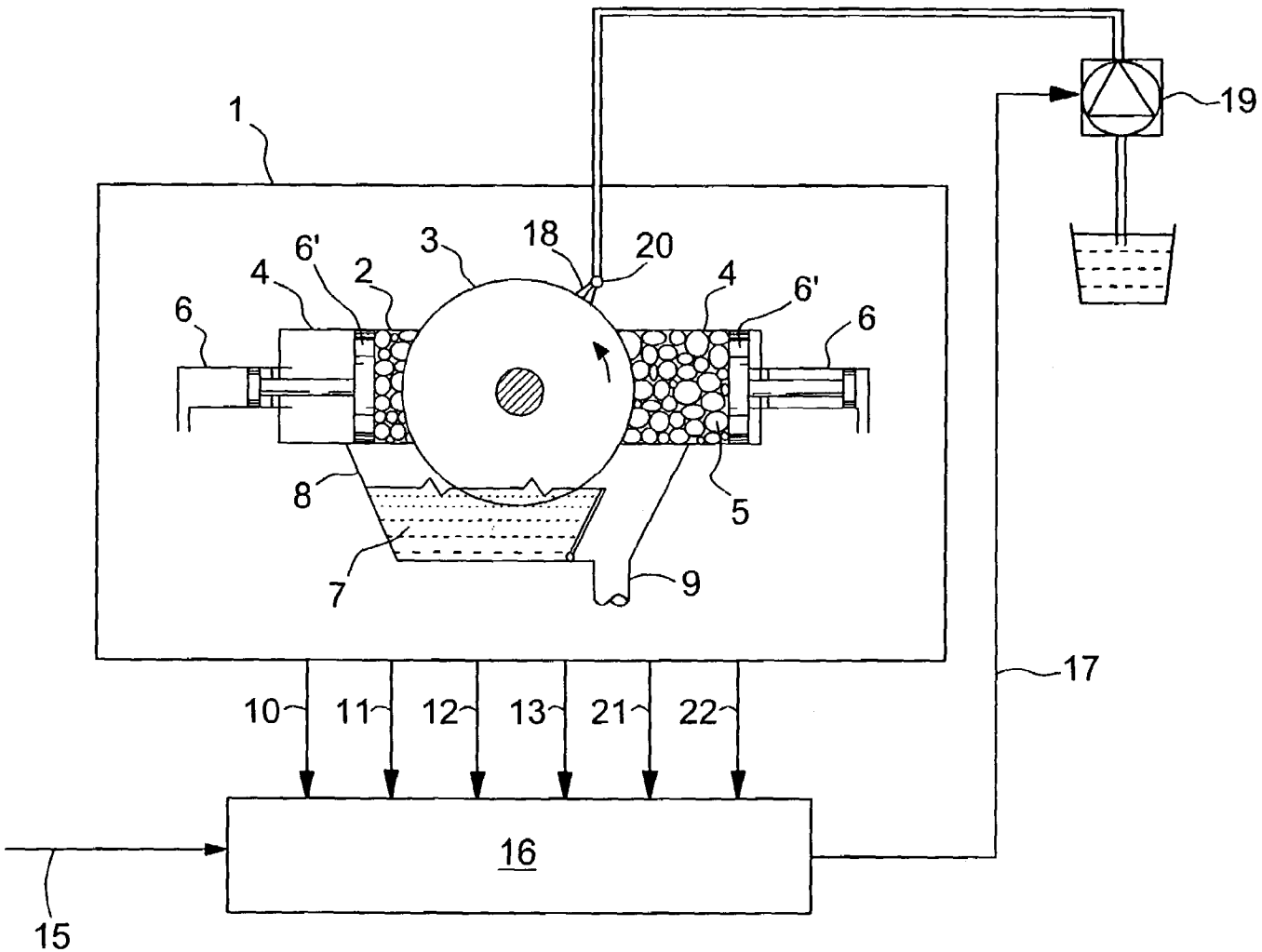
FIG. 1 is a schematic view of a two-pocket, piston-loaded pulp grinder suitable for the application of the method of the invention.

FIG. 1 shows a two-pocket, piston-loaded pulp grinder 1 comprising a body 2 and a pulpstone 3 mounted rotatably with bearings to the body 2 and having two grinding pockets 4A and 4B, on opposing sides thereof. On the pulpstone 3, there is typically an actual grinding surface, which is currently formed of grinding segments made of ceramics or a ceramics mixture or the like, that grinds the wood into fibers. In the pulp grinder 1, wood 5 is pressed against the pulpstone 3 by compression pistons 6 and pressure shoes 6' connected to them, producing fiber pulp 7 as water is, at the same time, sprayed to the grinding zone in a conventional manner. Though not shown in the figures, above or at the side of each pocket 4, a feed pocket is arranged for the wood batch to be fed into the pocket. Below the pulpstone 3, there is a tray 8 for the ground fiber pulp 7, and a discharge pipe 9 leads from the tray 8 to a further site of use. Different variables, such as production speed 10, the pressure 11 pressing the compression pistons 6, the power/current 12 of the motor (not shown) running the pulpstone 3, the CSF value 13 of the fiber pulp 7, the grinding speeds 21 of the pressure shoes 6', and the positions 22 of the pressure shoes 6', are measured from the fiber pulp 7 and pulp grinder 1. The target values 15 of variables defined for the operation of the water sharpening apparatus are combined with the above-mentioned factors by a control unit 16 of the water sharpening apparatus to obtain a control signal 17 for sharpening the pulpstone 3 with a water jet 18 of the water sharpening apparatus. On the basis of this, a pump unit 19 of the water sharpening apparatus is started and the sharpening is done with the water jet 18 by moving a nozzle 20 of the water sharpening apparatus. Said control unit 16 is a device that is capable of processing inputted data. The data inputted to the control unit 16 is both data collected from the pulp grinder 1 and data entered by the person monitoring the pulp grinding process to the control unit 16. The control unit 16 is typically a computer, and a computer program in its processor generates a water sharpening sequence and takes care of updates to the water sharpening sequence. The program code can be loaded from an internal memory of the control unit or it can be downloaded from a separate external memory media, such as CD-ROM disc. The program code can also be transferred through a telecommunications network, for instance by connecting the device to the Internet. It is also possible to use a hardware implementation or a combination of hardware and software solutions.

The arrangement intended for water-jet sharpening the pulpstone 3 of the pulp grinder 1 of the invention comprises two control circuits arranged to the control unit 16, namely a control circuit for adjusting the pressure of the pulpstone 3 treatment jet 18 and a control circuit for adjusting the treatment interval of the pulpstone 3. The pressure of the treatment jet 18 of the pulpstone 3 is preferably adjusted within the range of 800 and 2,500 bars depending on the quality of the fiber pulp 7 and the resources of the pulp grinder 1. The treatment interval of the pulpstone 3 is, in turn, adjusted so as to keep the pressure of the treatment jet 18 within said range. When the pressure of the treatment jet 18 approaches a predefined high limit of the pressure, the treatment interval of the pulpstone 3 is shortened, and correspondingly, when the pressure of the treatment jet 18 approaches a predefined low limit of the pressure, the treatment interval of the pulpstone 3 is lengthened.

Figure 2:
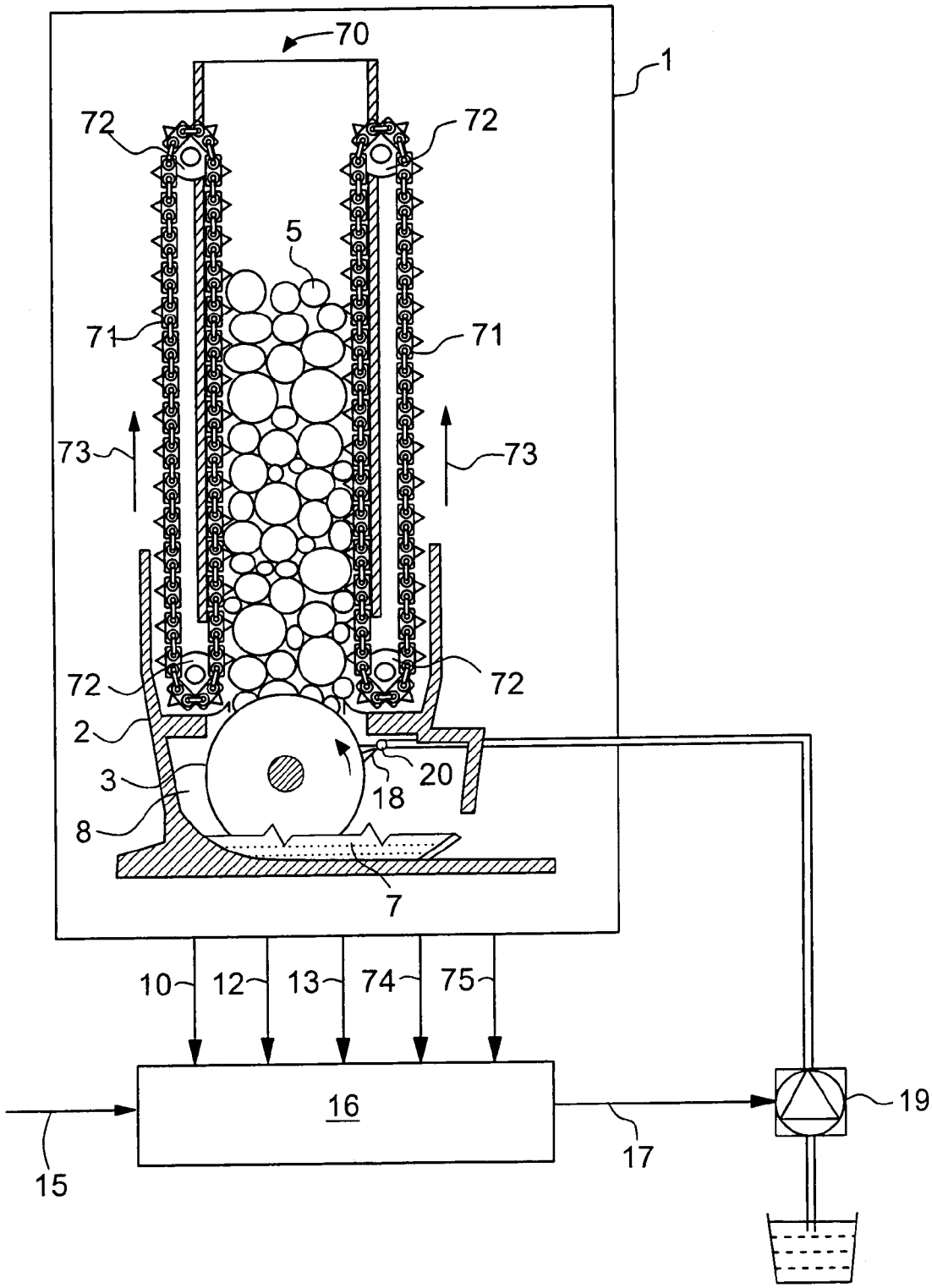
FIG. 2 is a schematic view of a chain pulp grinder suitable for the application of the method of the invention.

FIG. 2 shows a chain pulp grinder 1 that comprises a body 2 and a pulpstone 3 mounted rotatably with bearings to the body 2 and above the pulpstone 3, there is a wood pocket 70 comprising two endless chains 71 for feeding wood 5 against the pulpstone 3. The chains are arranged to rotate around turning wheels 72. The turning wheels 72 are connected to drives (not shown) that turn them. The direction of travel of the chains 71 outside the wood pocket 70 is shown by arrow 73. Below the pulpstone 3, there is a tray 8 for ground fiber pulp 7, from which tray 8 the fiber pulp 7 is led to a further site of use. Different variables, such as production speed 10, the power 74 of the drives running the chains 71, the power/current 12 of the motor (not shown) running the pulpstone 3, the CSF value 13 of the fiber pulp 7, and the speed 75 of the chains, are measured from the fiber pulp 7 and pulp grinder 1. The target values 15 of variables defined for the operation of the water sharpening apparatus are combined with the above-mentioned factors by the control unit 16 of the water sharpening apparatus to obtain a control signal 17 for sharpening the pulpstone 3 with the water jet 18 of the water sharpening apparatus. On the basis of this, the pump unit 19 of the water sharpening apparatus is started and the sharpening is done with the water jet 18 by moving the nozzle 20 of the water sharpening apparatus.

The arrangement intended for water-jet sharpening the pulpstone 3 of the pulp grinder 1 of the invention comprises two control circuits arranged to the control unit 16, namely a control circuit for adjusting the pressure of the pulpstone 3 treatment jet 18 and a control circuit for adjusting the treatment interval of the pulpstone 3. The pressure of the treatment jet 18 of the pulpstone 3 is preferably adjusted within the range of 800 and 2,500 bars depending on the quality of the fiber pulp 7 and the resources of the pulp grinder 1. The treatment interval of the pulpstone 3 is, in turn, adjusted so as to keep the pressure of the treatment jet 18 within said range. When the pressure of the treatment jet 18 approaches a predefined high limit of the pressure, the treatment interval of the pulpstone 3 is shortened, and correspondingly, when the pressure of the treatment jet 18 approaches a predefined low limit of the pressure, the treatment interval of the pulpstone 3 is lengthened.

The calculation principles, on which the arrangement of the invention for controlling the water-jet sharpening sequence of the pulpstone 3 of the pulp grinder is based, will now be described in greater detail.

Power Saturation Degree

The power saturation degree describes the power used in the pulp grinder 1. The power saturation degree is the portion of normal grinding time that the pulp grinder 1 grinds at its top power. The top power refers herein to a high limit set for the grinding power, which, if exceeded for a long time, would cause the motor of the pulp grinder 1 to overload. Normal grinding refers herein to a situation where both pockets 4 of a piston-loaded pulp grinder 1 are set for grinding at the same time. Because a chain pulp grinder is a continuous grinder, its power saturation is calculated for the entire grinding time with an examination period.

The power saturation degree is calculated using the following formula:

$$P_S = 100 \times \frac{T_{mp}}{T_n}, \tag{1}$$

wherein $P_S$=power saturation degree, [%]

$T_{mp}$=cumulative time during normal grinding, when the grinding power 12 of the pulp grinder 1 is above the top power during the calculation period T, [s]

$T_n$=cumulative normal grinding time during the calculation period T, [s].

Grinding Pressure Saturation Degree

The grinding pressure saturation degree of a compression piston-fed pulp grinder describes the sufficiency of the grinding pressure during grinding. The grinding pressure saturation degree is the portion of normal grinding time that the pocket 4 in question grinds at its top pressure. The top pressure is for instance 2 bars lower than the maximum pressure generated by the high-pressure pump required in grinding. Said high-pressure pump generates pressure 11 to the compression pistons 6 and the pressure shoes 6' connected to the pistons press the wood blocks 5 against the pulpstone 3. In a chain pulp grinder, the grinding pressure saturation can be compared to the saturation degree of the chain drive 74, this being the time that the drive power 74 has exceeded the set high limit during the examined period.

The grinding pressure saturation degree is calculated using the following formula:

$$GP_S = 100 \times \frac{T_{mgp}}{T_n}, \tag{2}$$

wherein $GP_s$=grinding pressure saturation degree, [%], $T_{mgp}$=cumulative time during normal grinding, when the pocket 4 in question grinds at a pressure higher than the top pressure during the calculation period T, [s]

$T_n$=cumulative normal grinding time during the calculation period T, [s].

In a chain grinder, the saturation degree of the chain drive is calculated from formula (2), but the term $T_{mgp}$ is the time that the power 74 of the chain drive is over the set high limit during the calculation period T.

Saturation Degree of Pressure Shoe 6' Speed Control

The saturation degree of the pressure shoe 6' speed control describes the operation of the slave controls of the pulp grinder 1. Slave controls refer herein to pulp grinder-specific load controls with which, depending on the loading method, the grinding power 12, pressure shoe 6' speeds 21 or pressure shoe 6' grinding pressures 11 are kept constant. The saturation degree of the pressure shoe 6' speed control is the portion of normal grinding time that the pocket 4 in question grinds with the output of the pressure shoe 6' speed control circuit higher than 95%, for instance.

The saturation degree of the pressure shoe 6' speed control is calculated using the following formula:

$$S_S = 100 \times \frac{T_{SS}}{T_n}, \tag{3}$$

wherein $S_s$=saturation degree of the pressure shoe 6' speed control, [%]

$T_{ss}$=cumulative time during normal grinding, when the output of the pressure shoe 6' speed control circuit of the pocket 4 is higher than 95%, for instance, during the calculation period T, [s]

$T_n$=cumulative normal grinding time during the calculation period T, [s].

Average Speed Lack of Pressure Shoe 6'

The average speed lack indicates lack of resources in the pulp grinder 1.

When $S_{set}(n)>S_m(n)$, the average speed lack is calculated using the formula:

$$ME_{neg} = \frac{\sum_{n=1}^{T} (S_m(n) - S_{set}(n))}{N_n}, \tag{4}$$

wherein $ME_{neg}$=average speed lack, [mm/s]

$S_{set}(n)$=setting of grinding speed 21 at sampling time n, [mm/s]

$S_m(n)$=measuring value of grinding speed 21 at sampling time n, [mm/s]

$N_n$=number of samples during normal grinding during the calculation period T, [number].

The corresponding term for the negative pressure shoe speed deviation in a chain pulp grinder is the speed lack of chain and it is calculated as the difference between the measured chain speed 75 and the rate of travel of wood. The rate of travel of wood can also be calculated from the measured jet stream and the measured pulp consistency.

Quality of Fiber Pulp 7

The quality of the fiber pulp 7 is described using a logarithmic CSF model. The model is presented as follows:

$$CSF = e^{\left[\frac{A-SEC}{B}\right]}, \tag{5}$$

wherein

CSF=calculated CSF value 26, [ml]

A and B=wood type-specific parameters

SEC=average specific energy consumption during normal grinding during the calculation period T, [MWh/t]

Specific Energy Consumption

Specific energy consumption in grinding is calculated using the following formula:

$$SEC = \frac{P}{m_{grinder}}, \tag{6}$$

wherein

SEC=specific energy consumption, [MWh/t]

P=average grinding power during normal grinding during the calculation period T, [MW]

$m_{grinder}$=average production speed of pulp grinder 1 during normal grinding during the calculation period T, [t/h]

Production Speed of Pulp Grinder 1

The production speed of a compression piston-loaded pulp grinder 1 is calculated during normal grinding as a total of the pocket-specific production speeds:

$$m_{grinder}=m_{pocket(a)}+m_{pocket(b)}, \tag{7}$$

wherein $m_{grinder}$=production speed of pulp grinder 1, [t/h]

$m_{pocket(a)}$=A-pocket 4 production speed, [t/h]

$m_{pocket(b)}$=B-pocket 4 production speed, [t/h]

The production of a chain pulp grinder 1 can be calculated from the measured speed of wood. In both pulp grinder types, the grinder-specific production speed 10 can also be calculated as a product of the jet streams and measured consistency.

Pocket-Specific Production Speed of Compression Piston-Loaded Grinder 1

The pocket-specific production speed 10 is calculated using the advance of the pressure shoe 6', wherein a model describing the compression of the wood batch 5 during grinding and the pressure shoe 6' speed is:

$$m_{pocket} = \frac{b \times \sum_{n=1}^{T} a(x) \times S(n)}{N_n}, \tag{8}$$

wherein $m_{pocket}=m_{pocket(a)}$ or $m_{pocket(b)}$, wherein a(x)=function describing the batch compression as a function of the relative advance of the pressure shoe 6' scaled to an average of 1.

$$a(x)=A+Bx+Cx^2, \tag{9}$$

wherein x=relative advance of the pressure shoe 6' at high-pressure grinding 0 . . . 1 b=conversion factor from the speed of the pressure shoe 6' to the production speed, [mm/s->t/h]

A,B,C=empirical constants

S(n)=speed of pressure shoe 6' during normal grinding during sampling time, [mm/s]

$N_n$=number of samples during normal grinding during the calculation period T, [number].

Calculation Period

Calculations are done during normal grinding as period average values during the calculation period T. The calculation period T is preferably 15 minutes. The time can also be longer or shorter.

In the arrangement of the invention, the treatment pressure of the pulpstone 3 surface of a compression piston-loaded pulp grinder 1 is controlled with a so-called fuzzy logic device having as inputs filtered values of the error value of the CSF setting provided by the operator and the computational current CSF value (formula (5)) and the average value of the speed lack of the A and B pockets 4 (formula (4)) or the average value of the saturation degree of the speed control of the A and B pockets 4 (formula (3)) or the average value of the grinding pressure saturation degree of the A and B pockets (formula (2)) or the power saturation degree (formula (1)). Correspondingly, in a chain grinder, the inputs of the fuzzy logic device are the error value of the CSF setting provided by the operator and the computational CSF value 26 (formula (5)) and the speed lack of chain or the saturation degree of the power/current of the chain drive or the power saturation degree (formula (1)). The computational CSF value 26 can also be a measured CSF value 13 or a computational CSF value 25 corrected with the measured CSF value 13.

Instead of a fuzzy logic device, it is also possible to use a model, in which values of formulas (1) to (5) are combined in different ways and using different weighting coefficients.

The input signals can, if necessary, be filtered with a low-pass filter, for instance.

The pressure setting is preferably calculated at 15-minute intervals with the fuzzy logic. The minimum value of the setting is preferably 800 bars and the maximum value is preferably 2500 bars.

The adjustment of the treatment interval ensures that the treatment pressure remains within said control range and does not drift towards either side. Because the wear of the pulpstone 3 is proportional to the amount of energy used in grinding with it, it is advantageous to base the treatment interval on the cumulative grinding energy during the grinding time of the pulp grinder 1. The sharpening interval is adjusted by controlling the energy consumption during the sharpening interval. The adjustment can then also be based on the grinding time. When grinding at low power, the sharpening is done at long intervals, and when grinding at high power, the sharpening is correspondingly done at short intervals.

The adjustment of the treatment interval makes the currently used treatment interval longer when the pressure setting of the water sharpening pressure calculated by the control circuit is lower than the low limit of the pressure range, which is preferably 900 bars. Correspondingly, the adjustment of the treatment interval makes the currently used treatment interval shorter when the pressure setting of the water sharpening pressure calculated by the control circuit is higher than the high limit of the pressure range, which is preferably 2,300 bars.

The decision to start the treatment is based on the cumulative grinding energy from the previous treatment. When the cumulative grinding energy value exceeds the energy value calculated during the previous treatment in the control unit 16, water sharpening is started. The energy counter is then reset and a new cumulative energy value is calculated for the next water sharpening operation.

Figure 3:
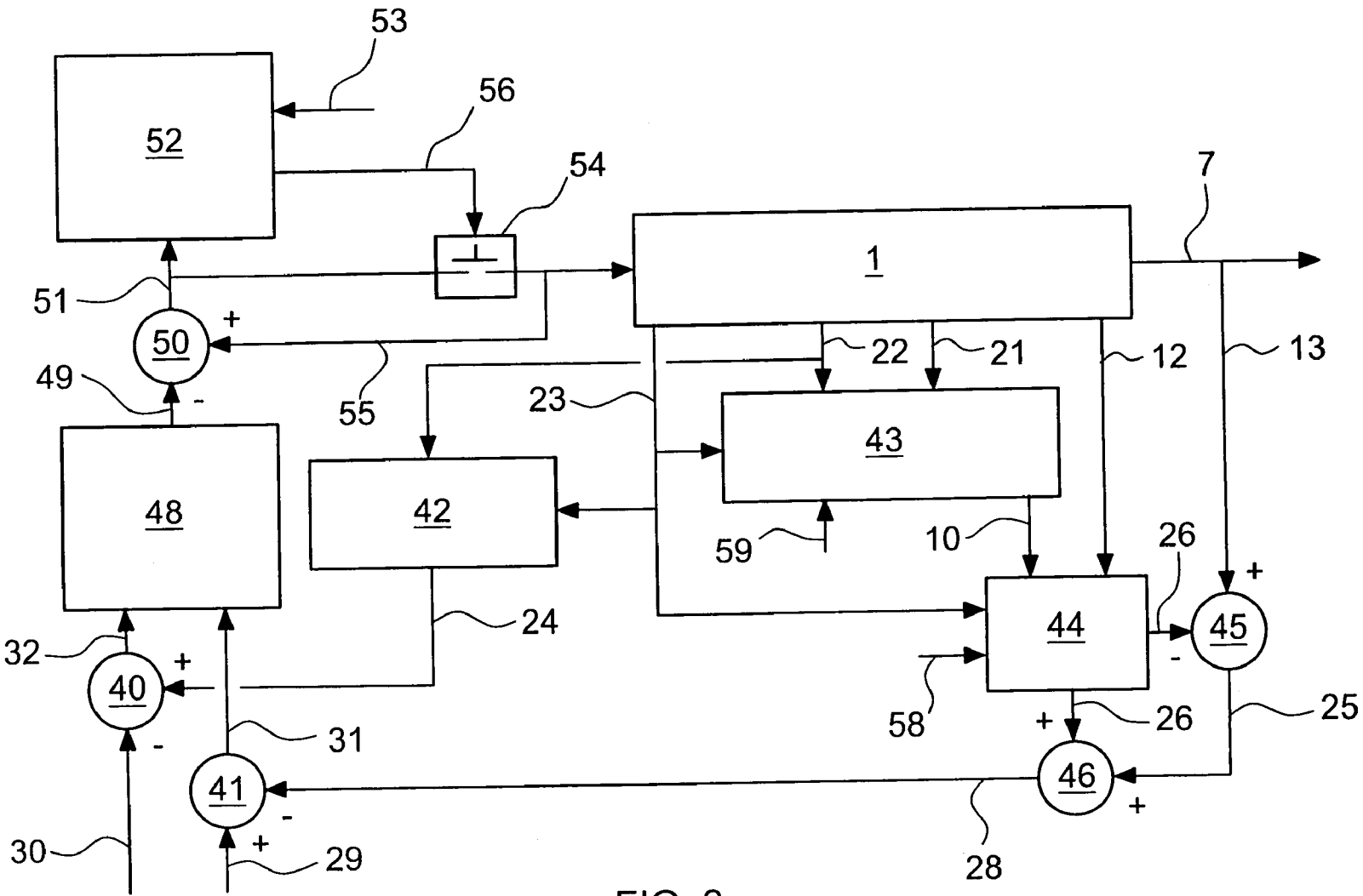
FIG. 3 is a schematic view of an embodiment of the invention.

FIG. 3 is a schematic view of an embodiment of the invention, in which the water sharpening pressure is adjusted as the primary control variable and the water sharpening interval as the secondary control variable. The arrows show the data flows and the blocks show the calculation taking place in the control unit 16. The circles are summing elements. For the sake of clarity, the calculation is shown for one grinding pocket only.

The production speed of the pocket of the pulp grinder 1 during high-pressure grinding 23 is calculated in block 43 using the position signals 22 of the pressure shoe 6', speed signals 21 and high-pressure grinding data 23, and by using formulas (7), (8) and (9). The calculation is done as follows. First, the pocket-specific compression function is calculated with formula (9). The value of the compression function is 0, when the pocket 4 in question does low-pressure grinding. When the pocket 4 starts high-pressure grinding, the relative advance of the pressure shoe is scaled in such a manner that at the beginning of high-pressure grinding in said pocket 4, it is 0 and at the end of high-pressure grinding, it is 1. The presented function is a quadratic equation with some preferred factors provided for it. The essential for this compression function is the dimensionless number whose average value in the entire range of the relative position is 1. The scaling of the relative position is done separately for each pocket-full.

The average pocket-specific production speed for the calculation period is calculated using formula (8) from the compression function (9), scaling coefficient, pressure shoe speed 21 and number $N_n$ of samples. A condition for this calculation is that the pocket 4 is doing high-pressure grinding 23. For the sake of clarity, the diagram only shows the calculation of the production speed of one pocket. The average production speed of the pulp grinder 1 is calculated at the end of the calculation period with formula (7) as a sum of the pocket-specific production speeds. In the diagram, the production speed of the second pocket is marked with arrow 59.

The average energy consumption of the pulp grinder 1 during the calculation period is calculated in block 44 with formula (6) from the average power 12 of normal grinding measured during the calculation period, when both pockets 4 grind at high-pressure 23, by dividing it by the production speed 10 of the pulp grinder 1 calculated with formula (7).

The CSF value 26 of the pulp produced by the pulp grinder 1 is calculated using the energy consumption with formula (5). The coefficients A and B shown in the formula are wood-type- and pulpstone-specific constants that are determined case by case. Coefficients A and B are marked with arrow 58 in the figure.

Instead of the calculated CSF value 26, it is possible to use as feedback in a subtraction node 41 the measured CSF value 13 or a combination of the measured CSF value 13 and the calculated CSF value 26, in which case the calculated CSF value 26 is corrected with the measured CSF value 13. The correction is made in such a manner that the CSF value 13 is measured from a sample collected from the grinder pit pulp 7. The calculated CSF value 26 is subtracted from the measured CSF value 13 in step 45. This produces a correction term 25 of the calculated CSF value 26. The correction term 25 is added to the calculated CSF value 26 so as to make the calculated CSF value 28 correspond to the measured CSF value 13.

The error value 49 of the water jet sharpening pressure is calculated in block 48 on the basis of the CSF value error value 31, which is calculated with the summing node 41 from the CSF value setting 29 and the calculated CSF value 28, and the average speed lack of the pressure shoe 6'. The compression piston-specific speed lack 32 is calculated in block 42 during normal grinding 23 with formula (4) by subtracting the corresponding setpoint 30 from the pressure shoe speed measurement calculated during high-pressure grinding. The average value of the pocket-specific speed lacks is formed by dividing the sum of pocket-specific speed lacks by two. For the sake of clarity, the figure shows the calculation for one pocket 4 only, so the signal 32 is the average value of the pocket-specific speed lacks.

The water sharpening pressure 55 used during the previous adjustment cycle is added in the summing element 50 to the error value of the water jet sharpening pressure, which produces the new pressure setting 51. Various implementations can be used in calculating the error value 49 of the water jet sharpening pressure. The calculation in block 48 may be based on a multivariable algorithm, fuzzy logic, PID controller or a combination thereof. The pressure setting 51 is directed to the generation system of water sharpening pressure. The water sharpening pressure setting can also be calculated in block 48 without the feedback 55 of the previous calculation cycle, in which case the new water sharpening pressure setting 51 is the same as the output 49 of the water sharpening pressure adjustment. The pressure setting is preferably adjusted within the range of 800 to 2,500 bars.

The water sharpening power depends not only on the water sharpening pressure, but also on how often water sharpening is repeated. Because the dulling of the pulpstone 3 depends essentially on the amount of energy used in grinding with it, the water sharpening interval is naturally defined using the used amount of energy. The water sharpening interval setting is preferably adjusted within the range of 20 to 160 MWh. Water sharpening is done intermittently, because the change in sharpness as the stone dulls is quite slow and in a grinding mill, there is usually only one pump unit 19 generating water sharpening pressure that is used for as many as 12 different pulp grinders.

The principle in adjusting the water sharpening interval is to keep the water sharpening pressure within the control range 53. The water sharpening interval is adjusted in block 52. The treatment interval adjustment makes the used treatment interval longer when the water sharpening pressure setting calculated by the control circuit is lower than the low limit of the pressure range, which is preferably 900 bars. Correspondingly, the treatment interval adjustment makes the used treatment interval shorter when the water sharpening pressure setting calculated by the control circuit is higher than the high limit of the pressure range, which is preferably 2,300 bars.

When water sharpening is done, the next grinding energy value is calculated, with which water sharpening is done the next time. The starting command of water sharpening is shown by arrow 56 and switch 54 in the diagram.

Figure 4:
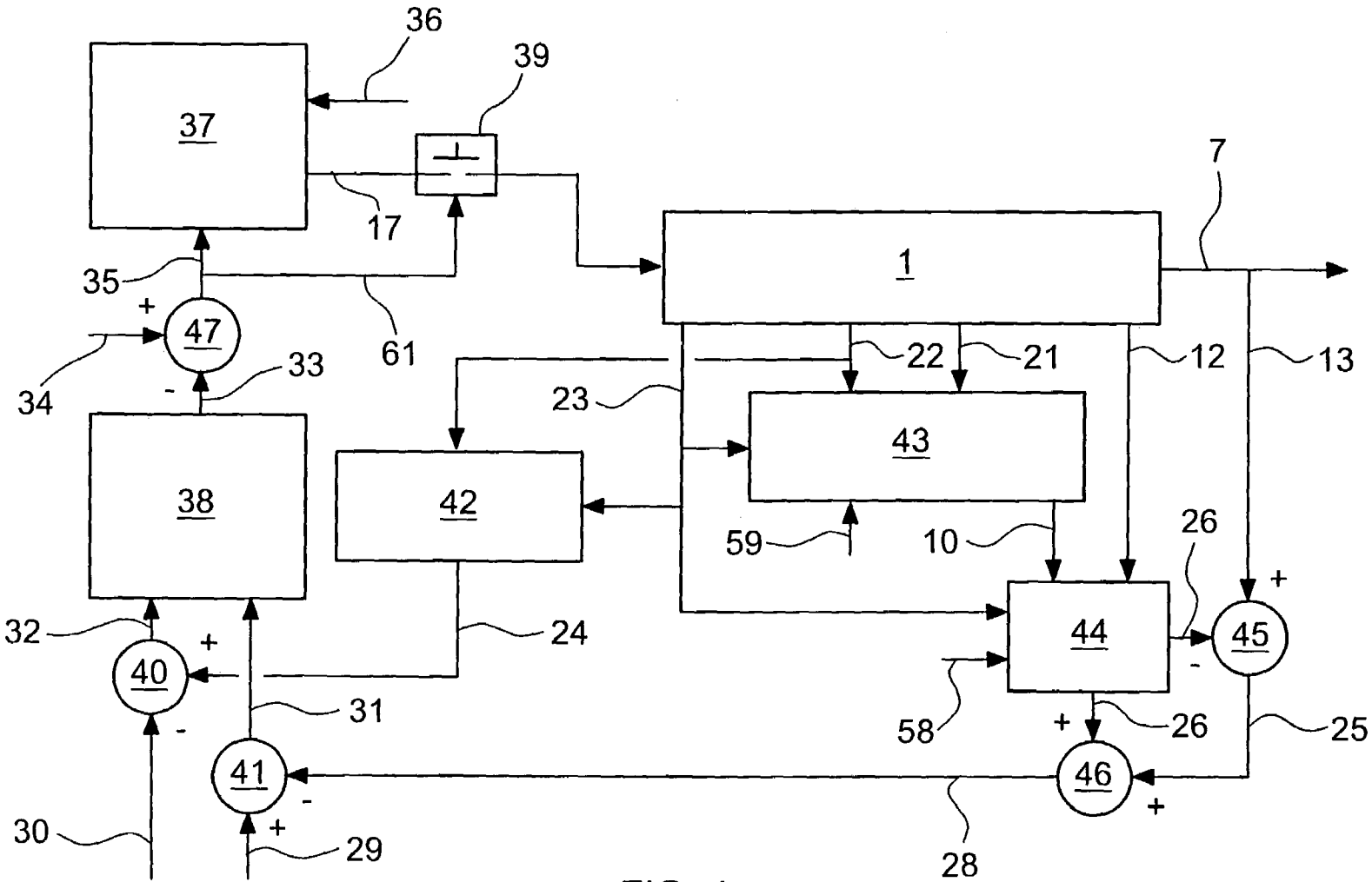
FIG. 4 is a schematic view of a second embodiment of the invention.

FIG. 4 is a schematic view of a second embodiment of the invention, in which the water sharpening interval is adjusted as the primary control variable and the water sharpening pressure as the secondary control variable. The arrows show the data flows and the blocks show the calculation performed in the control unit 16. The circles are summing elements. For the sake of clarity, the calculation is shown for one grinding pocket only.

The calculation of the production speed of the pulp grinder 1, the calculation of the CSF value and the calculation of the pressure shoe speed as well as the compensation of the calculated CSF value on the basis of laboratory values are consistent with what is stated in the description of diagram 3.

The water jet sharpening interval is calculated in step 38 on the basis of the CSF value error value 31 and the average speed lack 32 of the pressure shoe. The pressure shoe-specific speed lack is calculated during normal grinding with formula (4). The average of the pocket-specific speed lacks is formed by dividing the sum of pocket-specific speed lacks by two. For the sake of clarity, the figure shows the speed lack calculation for one pressure shoe 6' only.

Various implementations can be used in calculating the error value 33 of the water jet sharpening interval in step 38. The calculation may be based on a multivariable algorithm, fuzzy logic, PID controller or a combination thereof. The new setting 35 for the water sharpening interval is formed by summing the previous water sharpening interval 34 and the error value 33 in the summing element 47. In block 38, it is also possible to calculate the new setting of the water sharpening interval directly without the feedback 34 of the previous calculation cycle, in which case the new water sharpening interval setting 35 is the same as the output 33 of the water sharpening interval adjustment.

Because the dulling of the pulpstone 3 depends essentially on the amount of energy used in grinding with it, water sharpening interval refers herein to the amount of energy used in grinding. Preferably, the water sharpening setting is adjusted within the range of 20 to 160 MWh. Water sharpening is done intermittently, because the change in sharpness as the stone dulls is quite slow and in a grinding mill, there is usually only one pump unit 19 generating water sharpening pressure that is used for as many as 12 different pulp grinders.

The water sharpening pressure 17 is adjusted to keep the water sharpening interval 35 within the control range 36. The treatment pressure adjustment makes the currently used treatment pressure higher when the treatment interval setting calculated by the sharpening interval control circuit is lower than the low limit of the treatment interval, which is preferably 30 MWh. Correspondingly, the treatment pressure adjustment makes the currently used treatment pressure lower when the treatment interval setting calculated by the sharpening interval control circuit is higher than the high limit of the treatment interval, which is preferably 150 MWh. When water sharpening is done, a new pressure setting is calculated. Preferably, the pressure setting is adjusted within the range of 800 to 2,500 bars. The starting command of water sharpening is shown by arrow 61 and switch 39 in the diagram.

It is apparent to a person skilled in the art that while the technology advances, the basic idea of the invention can be implemented in many different ways. The examples described in the drawing are in no way intended to limit the idea of the invention, but to only illustrate the basic idea of the invention. Thus, the invention and its embodiments are not limited to the above examples, but may vary within the scope of the claims. The structure of the control unit is also in no way limited. The control unit can be implemented using the conventional analog technology, for instance, but most preferably by using a microprocessor or computer. Further, instead of the piston- or chain-operated wood feeding equipment described in the invention, the pulp grinder may be equipped with any known wood feeding mechanism, such as various screw-feed solutions.

That which is claimed:

1. A method for controlling a water jet sharpening sequence of a pulpstone in at least one of a piston-loaded pulp grinder and a chain-feed pulp grinder, wherein at least one sharpening water jet of a water sharpening apparatus, arranged with respect to the pulp grinder, is directed toward a surface of the pulpstone, the at least one sharpening water jet having a treatment pressure capable of detaching material from at least a portion of the surface of the pulpstone, whereby the surface of the pulpstone is treated over the width thereof as the pulpstone is rotated, said method comprising:

determining an actual quality value of at least one variable of a fiber pulp ground by the at least one of the piston-loaded pulp grinder and the chain-feed pulp grinder;

defining a target quality value for each of the at least one variable;

directing the actual quality value and the corresponding target quality value to a control unit of the water sharpening apparatus, the control unit being configured to be responsive thereto so as to provide an adjustment strategy, including a control range, for controlling the water jet sharpening sequence;

controlling the treatment pressure of the sharpening water jet relative to an error value between the target quality value and the corresponding actual quality value of the fiber pulp; and controlling a treatment interval to maintain the treatment pressure within the control range in accordance with the adjustment strategy.

2. A method for controlling a water jet sharpening sequence of a pulpstone in at least one of a piston-loaded pulp grinder and a chain-feed pulp grinder, wherein at least one sharpening water jet of the water sharpening apparatus, arranged with respect to the pulp grinder, is directed toward a surface of the pulpstone, the at least one sharpening water jet having a treatment pressure capable of detaching material from at least a portion of the surface of the pulpstone, whereby the surface of the pulpstone is treated over the width thereof as the pulpstone is rotated, said method comprising:

determining an actual quality value of at least one variable of a fiber pulp ground by the at least one of the piston-loaded pulp grinder and the chain-feed pulp grinder;

defining a target quality value for each of the at least one variable;

directing the actual quality value and the corresponding target quality value to a control unit of the water sharpening apparatus, the control unit being configured to be responsive thereto so as to provide an adjustment strategy, including a control range, for controlling the water jet sharpening sequence;

controlling a treatment interval relative to an error value between the target quality value and the corresponding actual quality value of the fiber pulp; and controlling the treatment pressure of the sharpening water jet to maintain the treatment interval within the control range in accordance with the adjustment strategy.

3. A method as claimed in claim 1 or 2, further comprising controlling at least one of the treatment pressure and the treatment interval of the sharpening water jet in proportion to consumption of resources associated with the pulp grinder so as to prevent a power consumption of a motor for rotating the pulpstone of the pulp grinder, a pressure of a hydraulic fluid for moving a piston of the piston-loaded pulp grinder, and a power consumption of a drive for running a chain of the chain-feed grinder from exceeding an optimum limit.

4. A method as claimed in claim 1 or 2, wherein the quality value comprises a Canadian Standard Freeness (CSF) and the method further comprises changing at least one of the treatment pressure and the treatment interval of the sharpening water jet in proportion to an error value between a target CSF value and an actual CSF value of the fiber pulp.

5. A method as claimed in claim 1 or 2, further comprising changing at least one of the treatment pressure and the treatment interval of the sharpening water jet in proportion to one of a speed lack of a pressure shoe of the piston-loaded pulp grinder and a speed lack of a chain of the chain-feed pulp grinder.

6. A method as claimed in claim 1 or 2, further comprising changing at least one of the treatment pressure and the treatment interval of the sharpening water jet in proportion to a saturation value of a power consumption of a motor for rotating the pulpstone of the pulp grinder.

7. A method as claimed in claim 1 or 2, further comprising changing at least one of the treatment pressure and the treatment interval of the sharpening water jet in proportion to one of a saturation value of a pressure of a hydraulic fluid for moving a piston of the piston-loaded pulp grinder, and a saturation value of a power consumption of a drive for running a chain of the chain-feed grinder.

8. A method as claimed in claim 1 or 2, further comprising changing at least one of the treatment pressure and the treatment interval of the sharpening water jet in proportion to a saturation value of a grinding speed control of the piston-loaded pulp grinder.

9. An apparatus for controlling a water jet sharpening sequence of a pulpstone in at least one of a piston-loaded pulp grinder and a chain-feed pulp grinder, the apparatus having at least one nozzle configured to be axially movable with respect to the pulpstone during sharpening thereof such that a width of the pulpstone is treated by a sharpening water jet, the sharpening water jet being pumped through a nozzle and sprayed therefrom by a pressure pump, directed against a surface of the pulpstone as the pulpstone is rotated, said apparatus comprising:

means for determining an actual quality value of at least one variable of the fiber pulp ground by the at least one of the piston-loaded pulp grinder and the chain-feed pulp grinder;

means for defining a target quality value for each of the at least one variable;

means for directing the actual quality value and the corresponding target quality value to a control unit of the water sharpening apparatus, the control unit being configured to be responsive thereto so as to provide an adjustment strategy, including a control range, for controlling the water jet sharpening sequence; and a control unit configured to control the treatment pressure of the sharpening water jet relative to an error value between the target quality value and the corresponding actual quality value of the fiber pulp, the control unit being further configured to control a treatment interval to maintain the treatment pressure within the control range in accordance with the adjustment strategy.

10. An apparatus for controlling a water jet sharpening sequence of a pulpstone in at least one of a piston-loaded pulp grinder and a chain-feed pulp grinder, the apparatus having at least one nozzle configured to be axially movable with respect to the pulpstone during sharpening thereof such that a width of the pulpstone is treated by a sharpening water jet, the sharpening water jet being pumped through a nozzle and sprayed therefrom by a pressure pump, directed against a surface of the pulpstone as the pulpstone is rotated, said apparatus comprising:

means for determining an actual quality value of at least one variable of the fiber pulp ground by the at least one of the piston-loaded pulp grinder and the chain-feed pulp grinder;

means for defining a target quality value for each of the at least one variable;

means for directing the actual quality value and the corresponding target quality value to a control unit of the water sharpening apparatus, the control unit being configured to be responsive thereto so as to provide an adjustment strategy, including a control range, for controlling the water jet sharpening sequence; and a control unit configured to control a treatment interval relative to an error value between the target quality value and the corresponding actual quality value of the fiber pulp, the control unit being further configured to control the treatment pressure of the sharpening water jet to maintain the treatment interval within the control range in accordance with the adjustment strategy.

11. An apparatus as claimed in claim 9 or 10, wherein the control unit is further configured to control at least one of the treatment pressure and the treatment interval of the sharpening water jet in proportion to consumption of resources associated with the pulp grinder so as to prevent a power consumption of a motor for rotating the pulpstone of the pulp grinder, a pressure of a hydraulic fluid for moving a piston of the piston-loaded pulp grinder, and a power consumption of a drive for running a chain of the chain-feed grinder from exceeding an optimum limit.

12. An apparatus as claimed in claim 9 or 10, wherein the quality value comprises a Canadian Standard Freeness (CSF) and the control unit is further configured to change at least one of the treatment pressure and the treatment interval of the sharpening water jet in proportion to an error value between a target CSF value and an actual CSF value of the fiber pulp.

13. An apparatus as claimed in claim 9 or 10, wherein the control unit is further configured to change at least one of the treatment pressure and the treatment interval of the sharpening water jet in proportion to one of a speed lack of a pressure shoe of the piston-loaded pulp grinder and a speed lack of a chain of the chain-feed pulp grinder.

14. An apparatus as claimed in claim 9 or 10, wherein the control unit is further configured to change at least one of the treatment pressure and the treatment interval of the sharpening water jet in proportion to a saturation value of a power consumption of a motor for rotating the pulpstone of the pulp grinder.

15. An apparatus as claimed in claim 9 or 10, wherein the control unit is further configured to change at least one of the treatment pressure and the treatment interval of the sharpening water jet in proportion to one of a saturation value of a pressure of a hydraulic fluid for moving a piston of the piston-loaded pulp grinder, and a saturation value of a power consumption of a drive for running a chain of the chain-feed grinder.

16. An apparatus as claimed in claim 9 or 10, wherein the control unit is further configured to change at least one of the treatment pressure and the treatment interval of the sharpening water jet in proportion to a saturation value of a grinding speed control of the piston-loaded pulp grinder.

* * * * *